US006093075A

United States Patent [19]

Lin

[11] Patent Number: 6,093,075

[45] Date of Patent: Jul. 25, 2000

[54] BUBBLE BLOWING TOY FOR BLOWING BIG BUBBLES

[76] Inventor: Mon-Sheng Lin, 5th Fl., No. 4, Lane 7, Pao Kao Road, Hsintien, Taipei Hsien, Taiwan

[21] Appl. No.: 09/166,706

[22] Filed: Oct. 5, 1998

[51] Int. Cl.[7] ..... A63H 33/28

[52] U.S. Cl. ..... 446/16

[58] Field of Search ..... 446/15, 16, 17, 446/18, 19, 20, 21

[56] References Cited

U.S. PATENT DOCUMENTS

| | | | |
|---|---|---|---|
| 2,606,395 | 8/1952 | Fulton | 446/15 |
| 2,836,926 | 6/1958 | Tseng | 446/15 |
| 4,790,787 | 12/1988 | Rector | 446/15 |
| 5,183,428 | 2/1993 | Lin | 446/15 |
| 5,653,620 | 8/1997 | Lin | 446/15 |

*Primary Examiner*—Robert A. Hafer
*Assistant Examiner*—Jeffrey D. Carlson
*Attorney, Agent, or Firm*—Dougherty & Troxell

[57] ABSTRACT

A bubble blowing toy including a solution container holding a solution and a bubble blowing device adapted to take up the solution from the solution container and to let the received solution be blowing into a big bubble. The bubble blowing device includes an operating unit and a bubble blowing unit pivoted to the operating unit and turned by the operating unit between a closed position and an opened position. The bubble blowing unit includes two long, arms connected to the operating unit and a folding arm coupled between the long arms at one end remote from the operating unit, with at least one of the long arms being pivoted to the operating unit and the folding arm having two opposite ends respectively pivoted to the long arms at one end remote from the operating unit.

7 Claims, 11 Drawing Sheets

BUBBLE BLOWING TOY FOR BLOWING BIG BUBBLES

BACKGROUND OF THE INVENTION

The present invention relates to a bubble blowing toy for blowing a solution into bubbles, and more particularly to a bubble blowing toy which is adapted to blow a solution into big bubbles.

A regular bubble blowing toy is generally comprised of a container holding a solution, and a bubble coil with a handle for blowing the solution into bubbles. Because the solution container is not convenient to be held by hand, the contained solution tends to be forced out of the solution container during playing. "Bubble Blowing Toy" of U.S. Pat. No. 5,183,428, which was issued to the present inventor, eliminates the aforesaid problem. According to U.S. Pat. No. 5,183,428, the bubble coil has the shape of a sword, and the solution container has the shape of a sheath adapted to receive the bubble coil. When the bubble coil is pulled out of the solution container and moved with the hand in the air, bubbles are produced. However, because the mouth of the sheath-like solution container is limited, the size of the bubble coil is limited too. In order to produce big bubbles, the size of the bubble coil must be relatively increased. "BUBBLE TOY WITH FLEXIBLE BUBBLE COIL" of U.S. Pat. No. 5,653,620, which is also an invention of the present inventor, provides a bubble toy with a flexible bubble coil. Because the bubble coil is flexible, it can be made having a relatively bigger size for blowing big bubbles.

SUMMARY OF THE INVENTION

The present invention provides a bubble blowing toy specifically designed for blowing a solution into big bubbles. According to one embodiment of the present invention the bubble blowing toy comprises a solution container holding a solution, and a bubble blowing device adapted to take up the solution from the solution container and to let the received solution be blown into a big bubble. The bubble blowing device comprises two long arms, an operating unit operated by hand to close and open the long arms, and a folding arm coupled between the long arms at one end remote from the operating unit.

DETAILED DESCRIPTION OF THE PREFERRED EMBODIMENT

Figure 10:
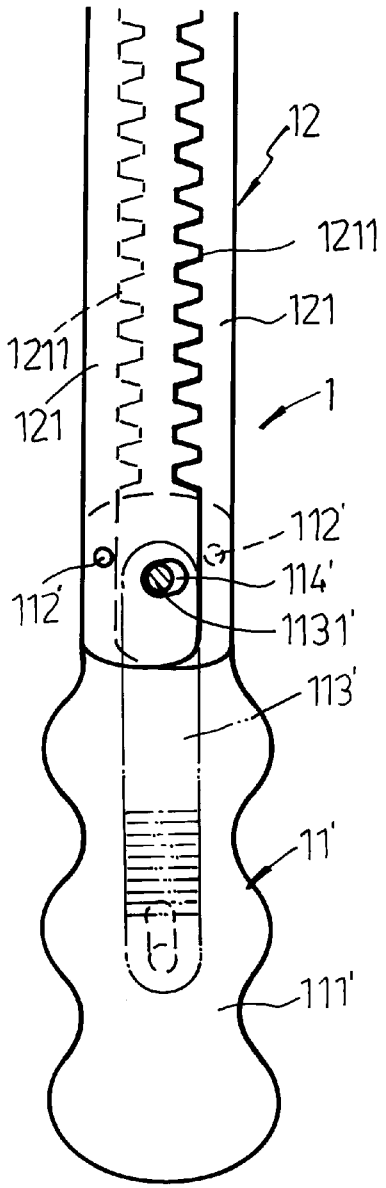
FIG. 10 is a plan view of a part of the second embodiment of the present invention, showing the bubble blowing device closed.
Figure 11:
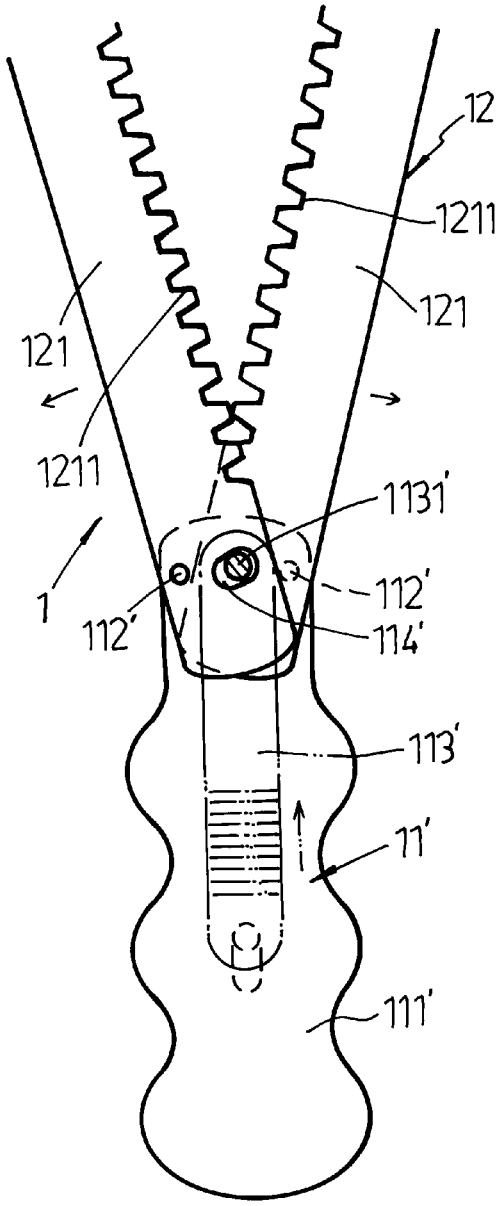
FIG. 11 is a plan view of a part of the second embodiment of the present invention, showing the bubble blowing device opened.
Figure 13:
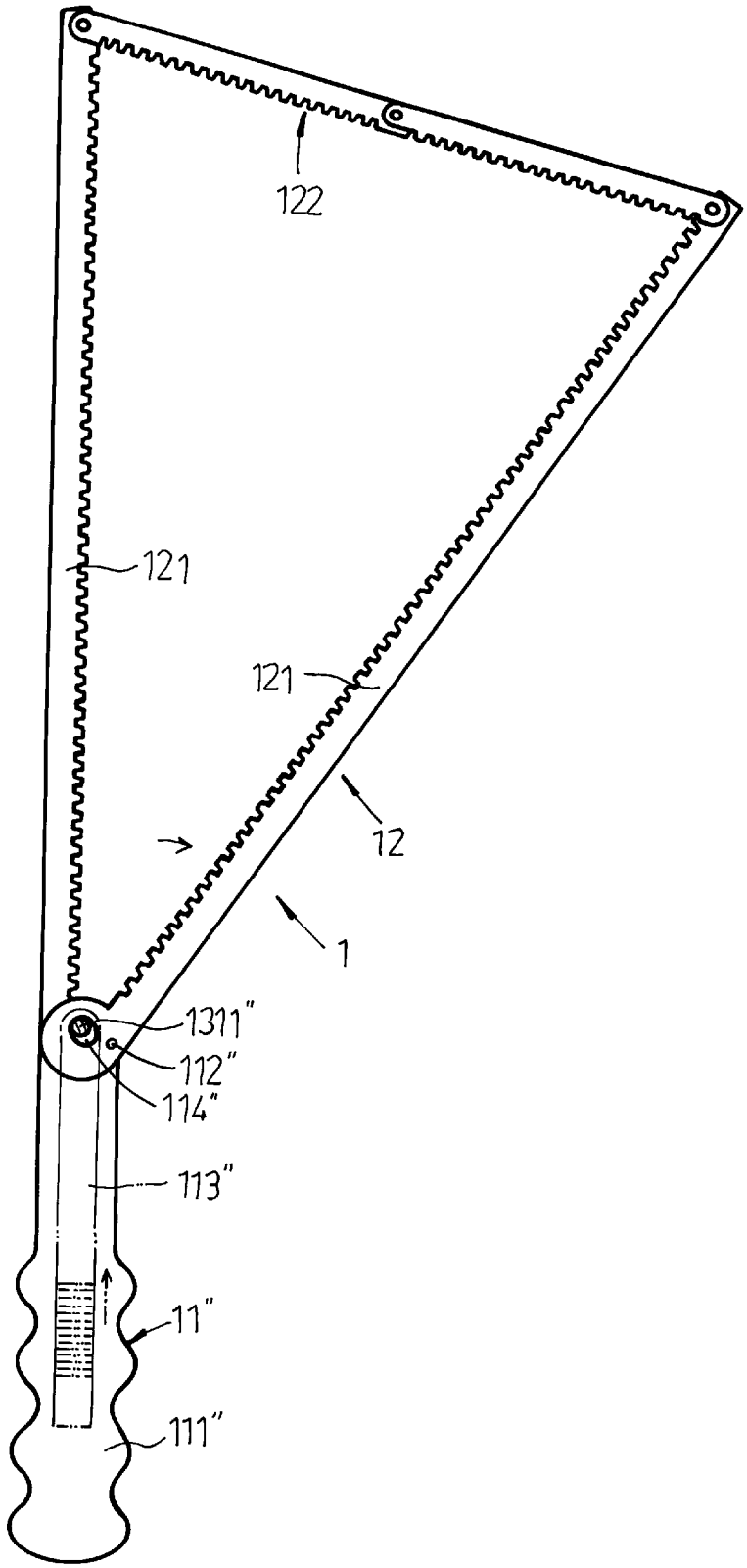
FIG. 13 illustrates the bubble blowing device of the third embodiment of the present invention opened.

Referring to FIGS. from 1 through 5, a bubble blowing toy in accordance with the present invention is generally comprised of a bubble blowing device 1, and a solution container 2. The bubble blowing device 1 is comprised of an operating unit 11, and a bubble blowing unit 12. The operating unit 11 can be operated by hand to close/open the bubble blowing unit 12. The solution container 2 comprises an opening 21 at one end of the elongated container body thereof. When the bubble blowing unit 12 is closed, it can be inserted through the opening 21 into the inside of the solution container 2 to take up the solution. The solution container 2 can have any of a variety of shapes. The operating unit 11 can be variously embodied. FIGS. from 1 through 9 show one form of the operating unit 11. FIGS. 10 and 11 show a second form of the operating unit 11'. FIG. 13 shows a third form of the operating unit 11".

Figure 12:
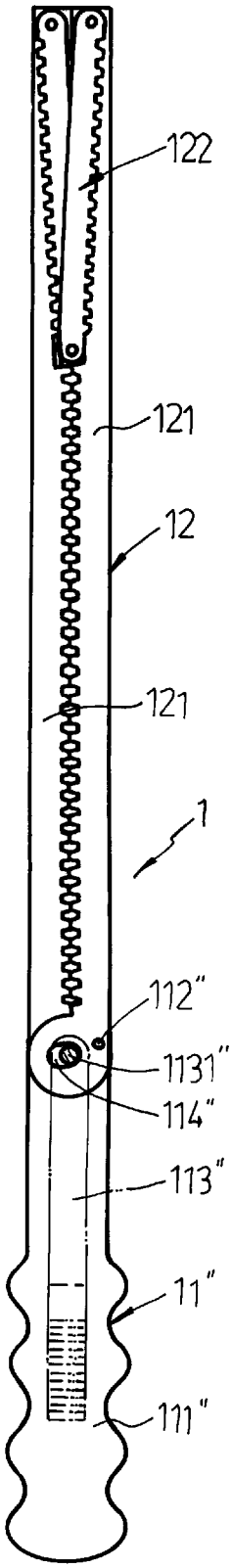
FIG. 12 is a plan view of a bubble blowing device for a bubble blowing toy according to a third embodiment of the present invention, showing the bubble blowing device closed.

Referring to FIGS. from 1 through 13, the bubble blowing unit 12 of the bubble blowing device 1 is comprised of two long arms 121, and a folding arm 122 coupled between the long arms 121 at one end remote from the operating unit 11. The arms 121,122 each have a serrated portion 1211,1221 longitudinally disposed at an inner side for taking up the solution. At least one long arm 121 is pivoted to the operating unit 11. As illustrated in FIGS. from 1 through 9, the long arms 121 are pivotably connected to the operating unit 11 by a pivot 112. In FIGS. 10 and 11 the long arms 121 are pivoted to the operating unit 11' by a respective pivot 112'. In FIGS. 12 and 13, only one long arm 121 is pivoted to the operating unit 11' by a pivot 112'.

The operating unit 11 can be operated by hand to move the long arms 121 between a closed position where the long arms 121 are closely attached together (see FIGS. 1, 4, 10 and 12), and an opened position where the long arms 121 are opened from each other and set into a V-shaped profile (see FIGS. 2, 5 through 8, 11 and 13). In FIGS. 12 and 13, the operating unit 11 is operated to move one long arm 121 relative to the other long arm, enabling the long arms 121 to be closed or opened.

Referring to FIGS. 10 and 11 again, the operating unit 11' comprises a handle 111', and a push bar 113'. The push bar 113' has a pivot 1131' coupled to oblong holes 114' on the long arms 121, the long arms 121 are respectively pivoted to the handle 111' by a respective pivot 112'. When the push bar 113' is pushed upwards as shown in FIG. 11, the long arms 121 are forced by the pivot 1131' of the push bar 113' to turn about the respective pivots 112' to the opened position.

Referring to FIGS. 12 and 13 again, the operating unit 11" comprises a handle 111", and a push bar 113". The push bar 113" comprises a pivot 1131" coupling to an oblong hole 114" at one long arm (the movable long arm) 121, which is pivoted to the handle 111" by a pivot 112". When the push bar 113" is pushed upwards (see FIG. 13), the pivot 1131" is forced to move the movable long arm 121, causing it to be turned about the respective pivot 112", and therefore the long arms 121 are set into the opened position.

Referring to FIGS. from 1 through 3 again, the folding arm 122 is comprised of two symmetrical halves pivoted together by a pivot 1223, having two opposite ends respectively pivoted to the ends of the long arms 121 by a respective pivot 1222. Further, a stop flange 1224 is provided at one half of the folding arm 122 adjacent to the pivot 1223 to limit the extended angle of the folding arm 122. The folding arm 122 can be turned inwards and folded up and received in between the long arms 121. When the long arms 121 are opened, the folding arm 122 is extended out and stopped by the stop flange 1224 in the extended position as shown in FIG. 2.

Figure 1:
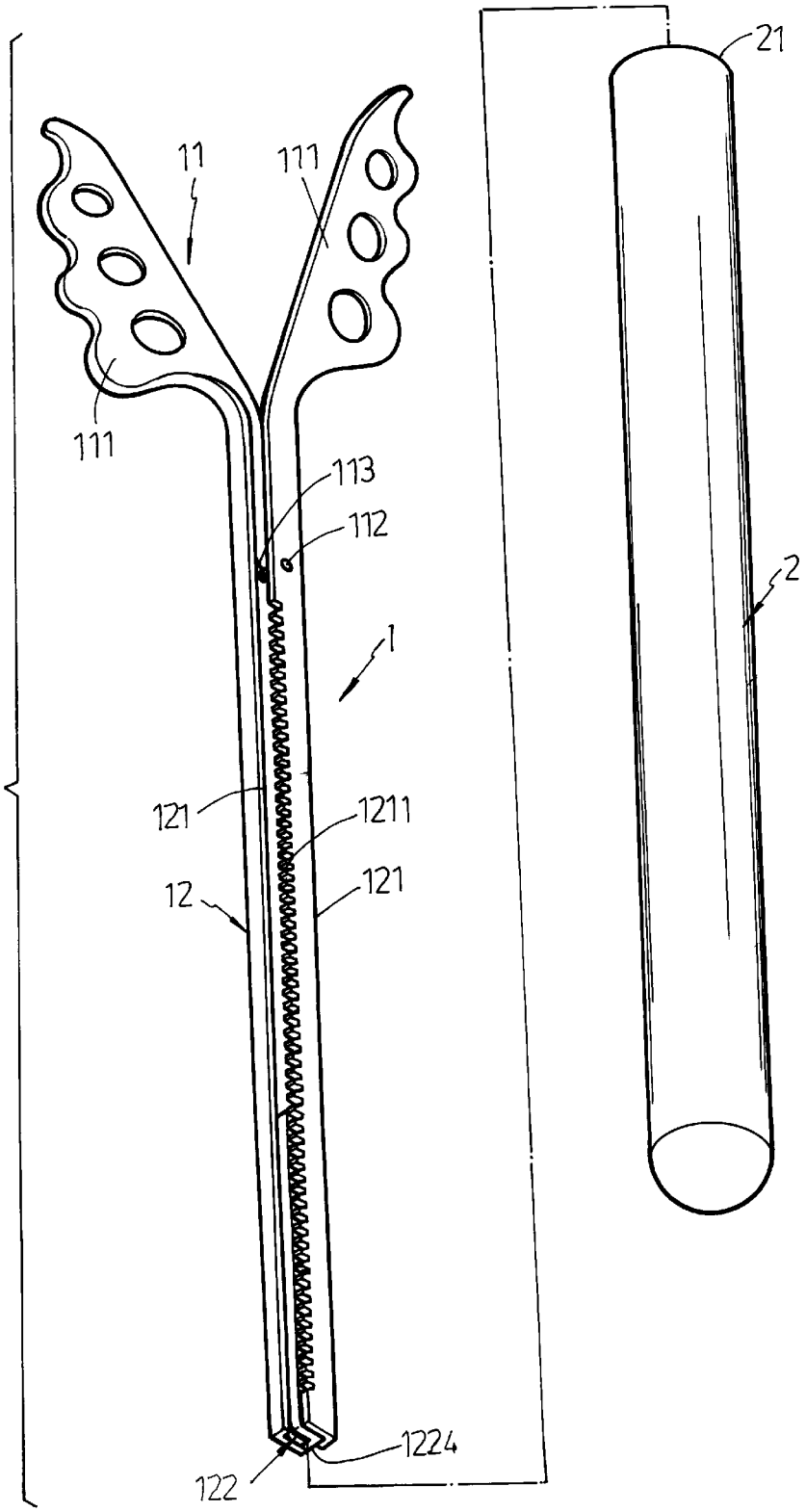
FIG. 1 is a perspective view of a bubble blowing toy according to a first embodiment of the present invention showing the bubble blowing device removed from the solution container.
Figure 2:
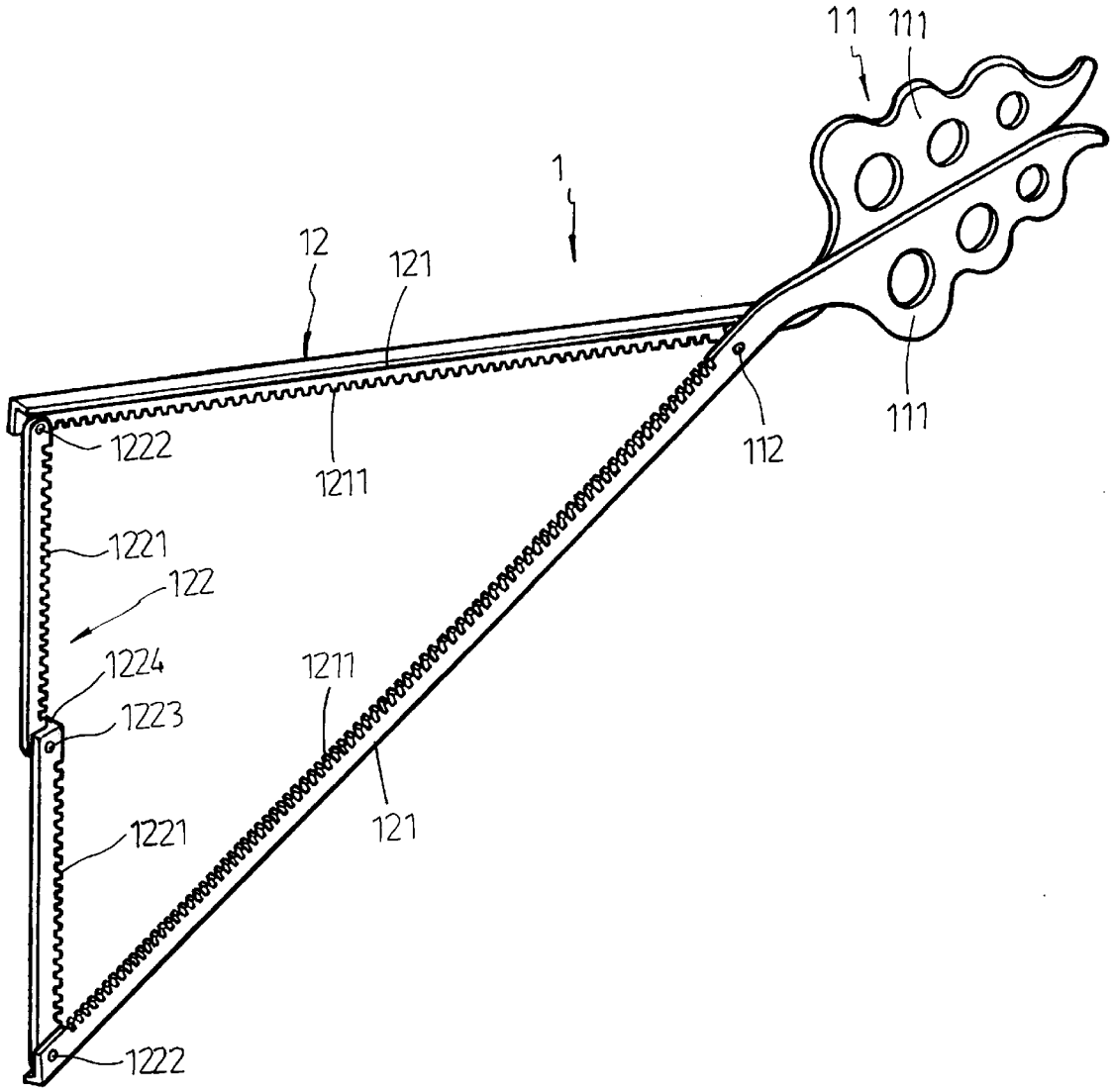
FIG. 2 illustrates the bubble blowing device of the first embodiment of the present invention opened.
Figure 3:
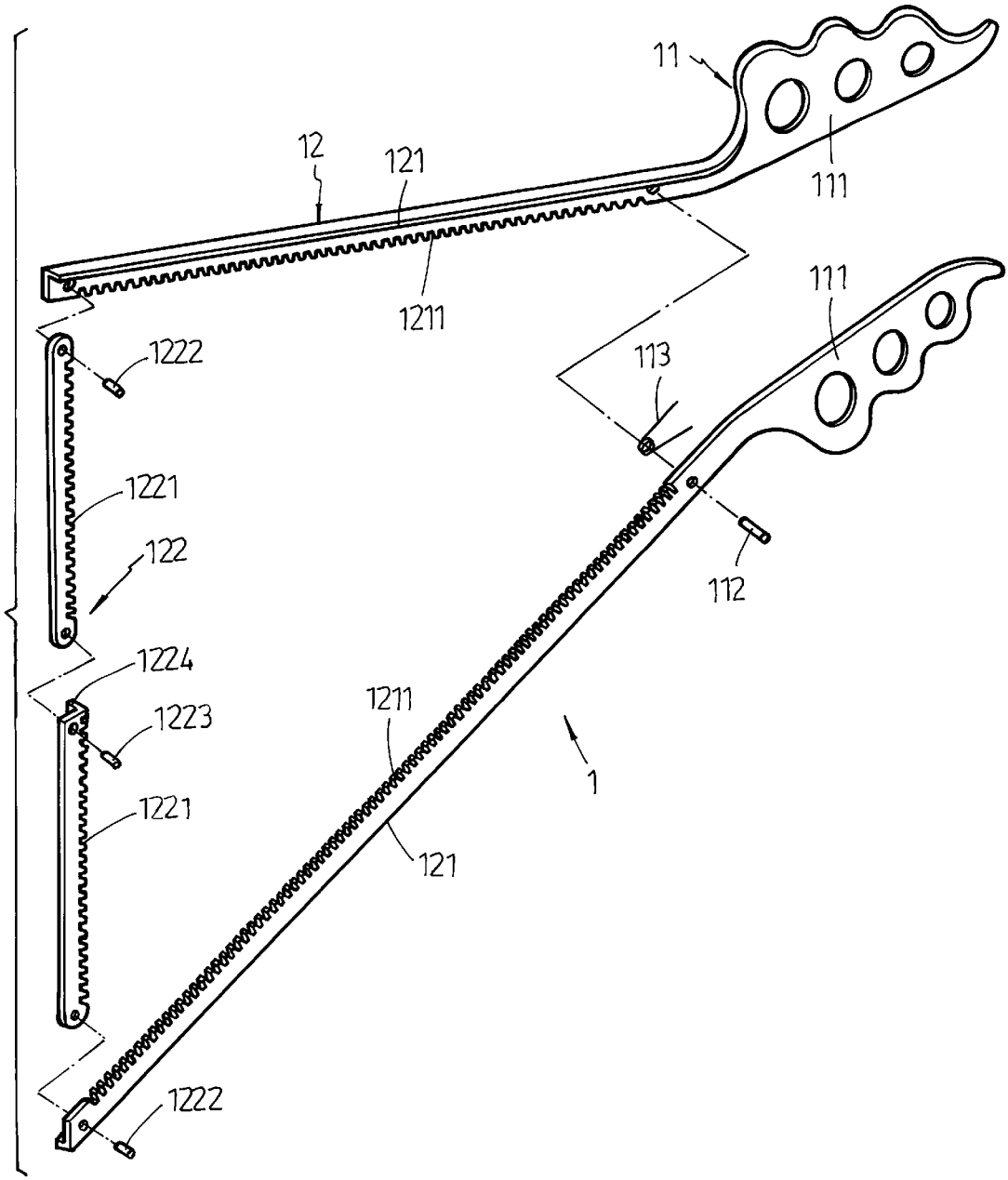
FIG. 3 is an exploded view of the bubble blowing device of the first embodiment of the present invention.
Figure 4:
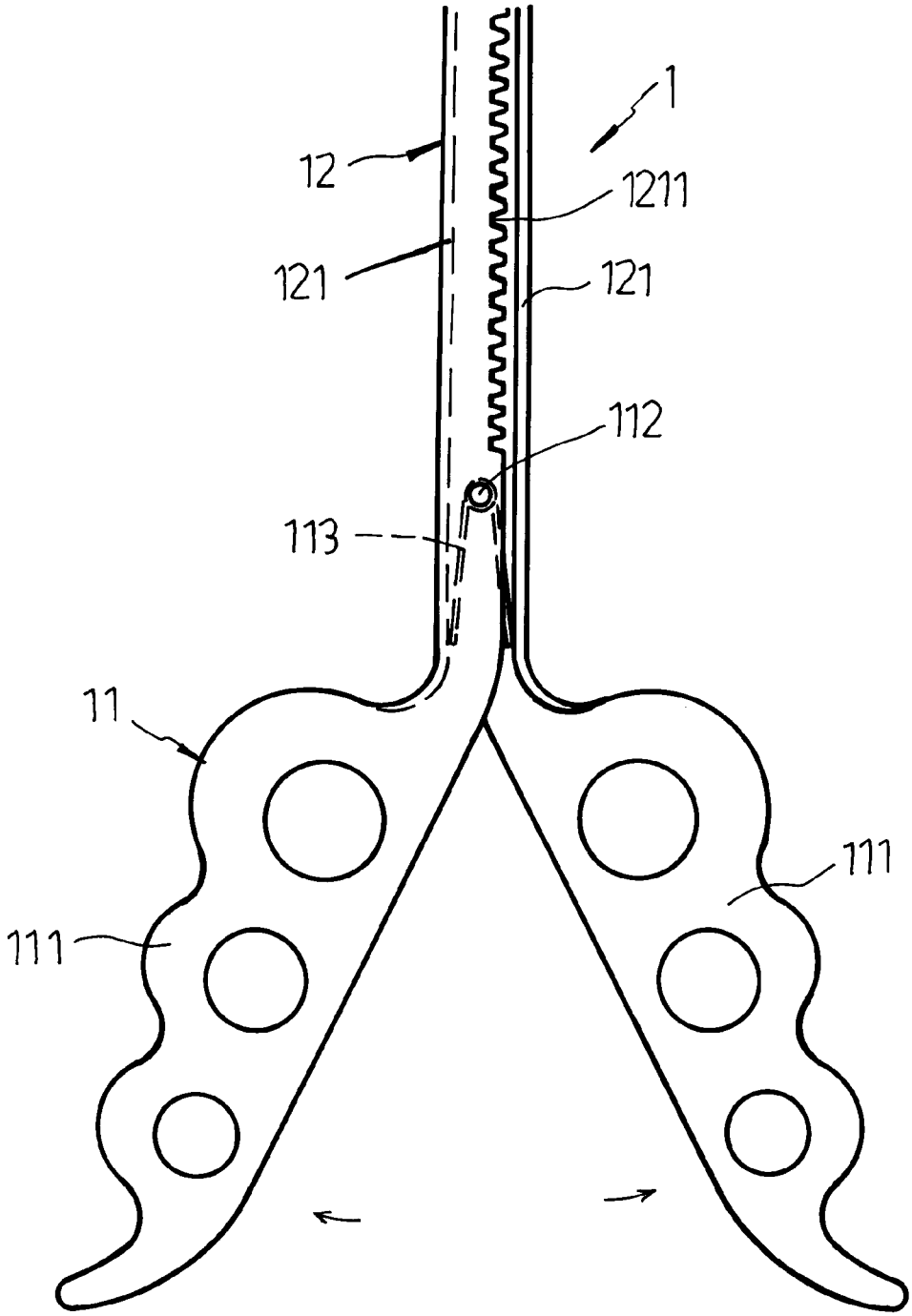
FIG. 4 is an enlarged view of a part of the first embodiment of the present invention, showing the bubble blowing device closed.
Figure 5:
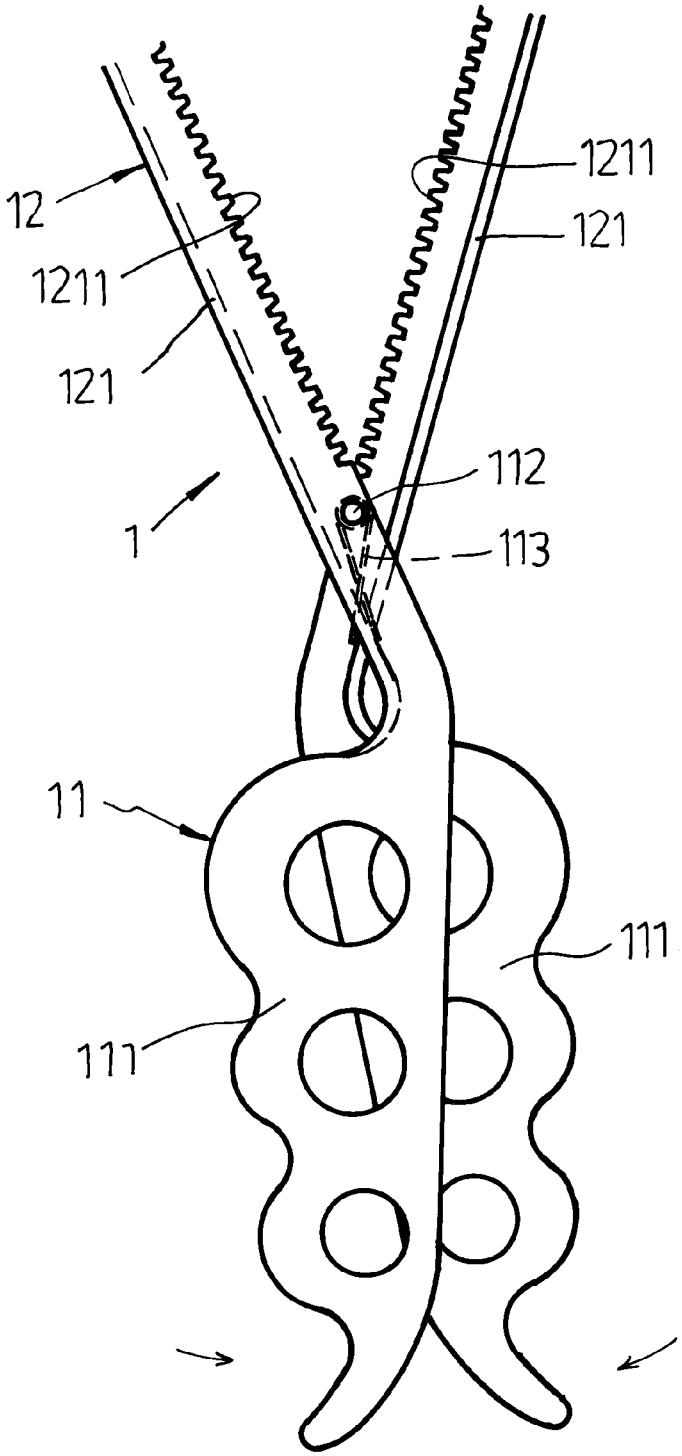
FIG. 5 is an enlarged view of a part of the first embodiment of the present invention, showing the bubble blowing device opened.
Figure 6:
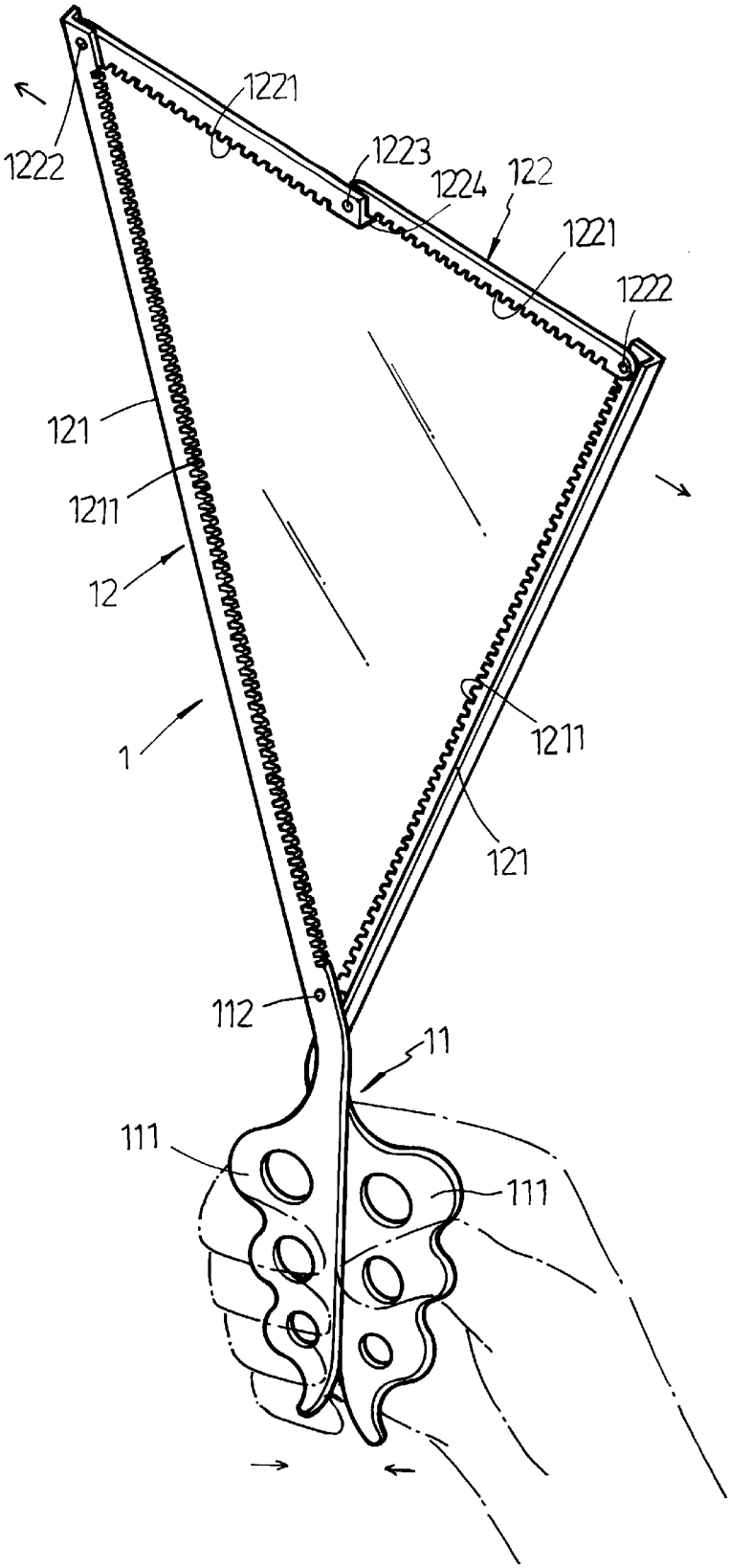
FIG. 6 is an applied view of the first embodiment of the present invention, showing a membrane of the solution suspended from the bubble blowing unit of the bubble blowing device.
Figure 7:
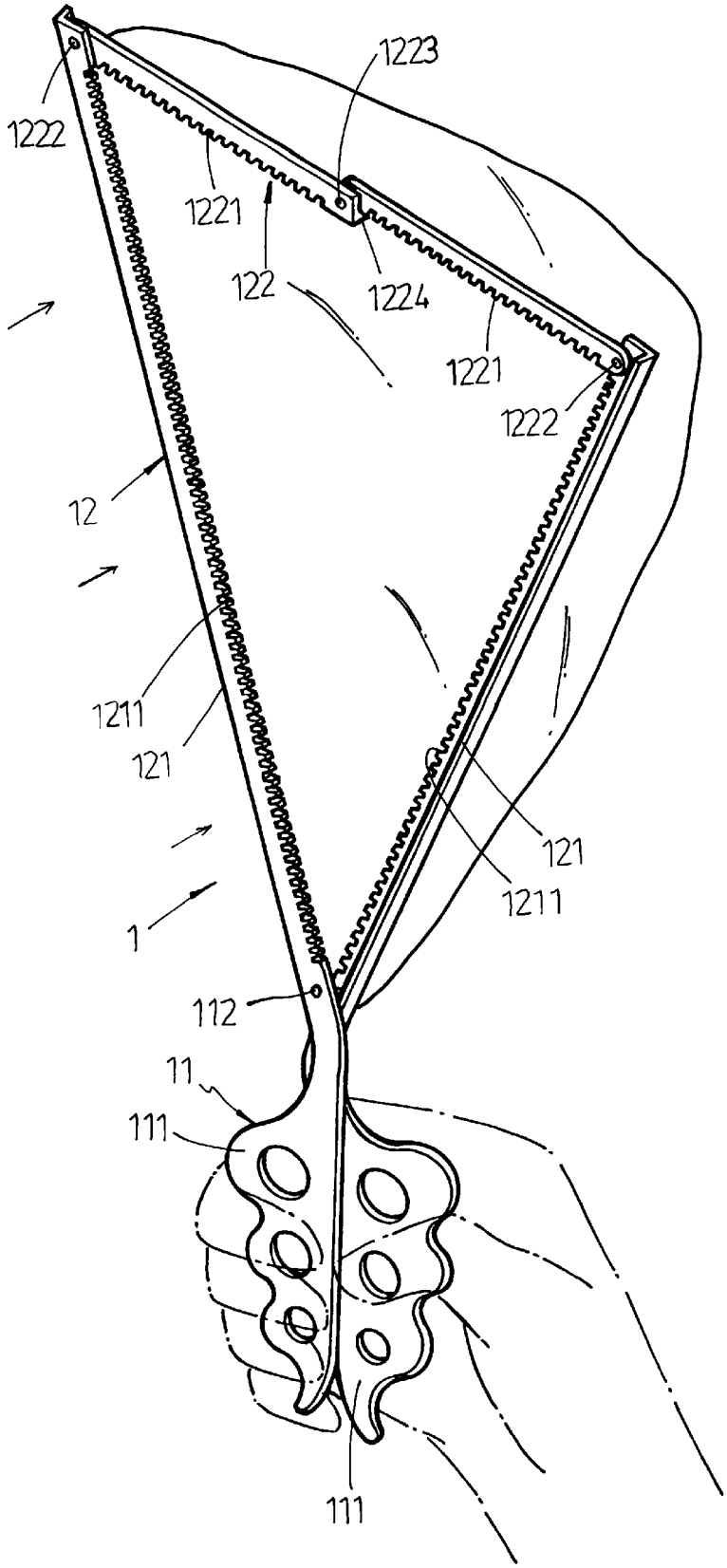
FIG. 7 is similar to FIG. 6 but showing the membrane blown into a bubble.
Figure 8:
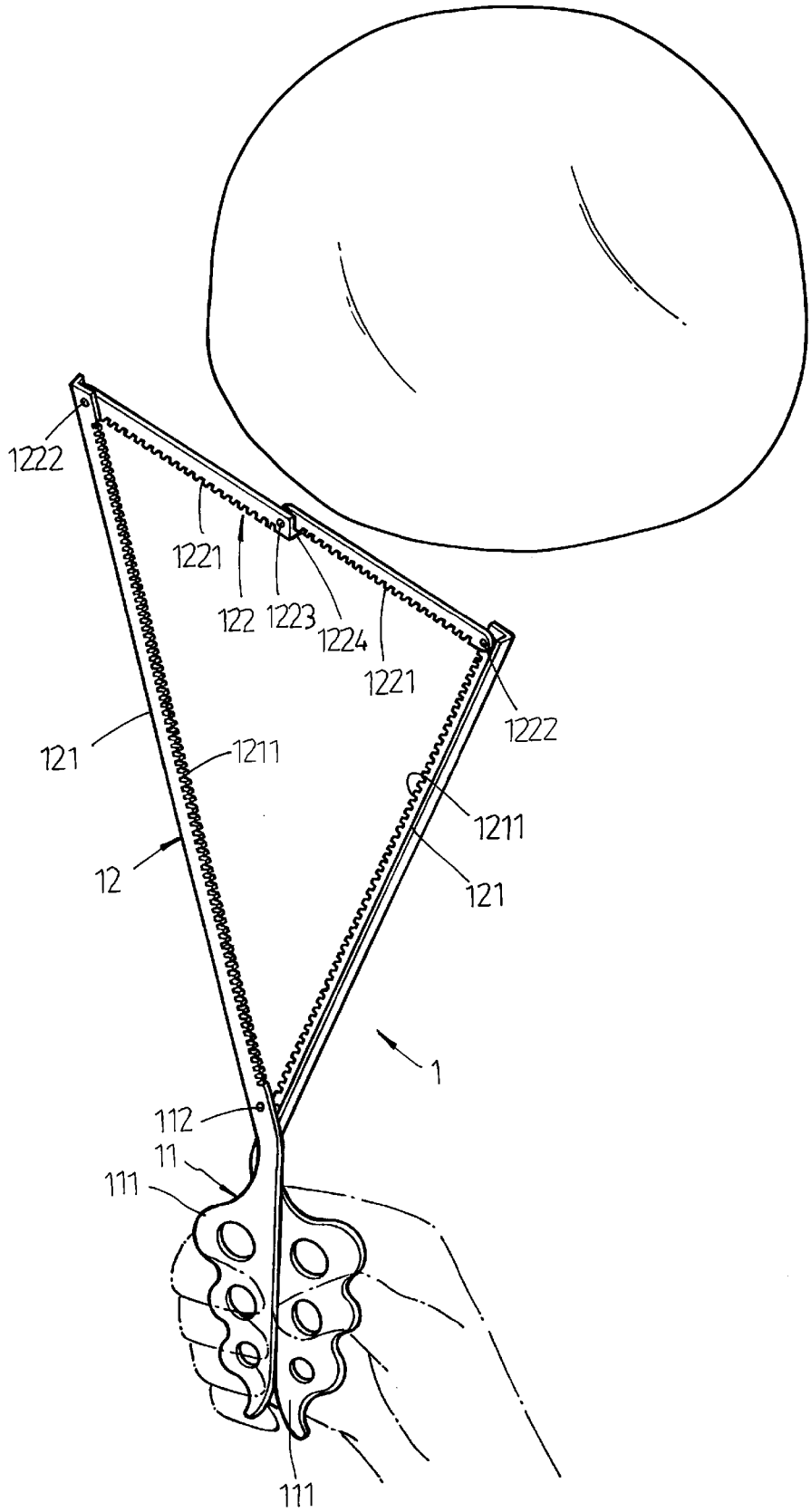
FIG. 8 is similar to FIG. 7 but showing the bubble blown away from the bubble blowing unit.
Figure 9:
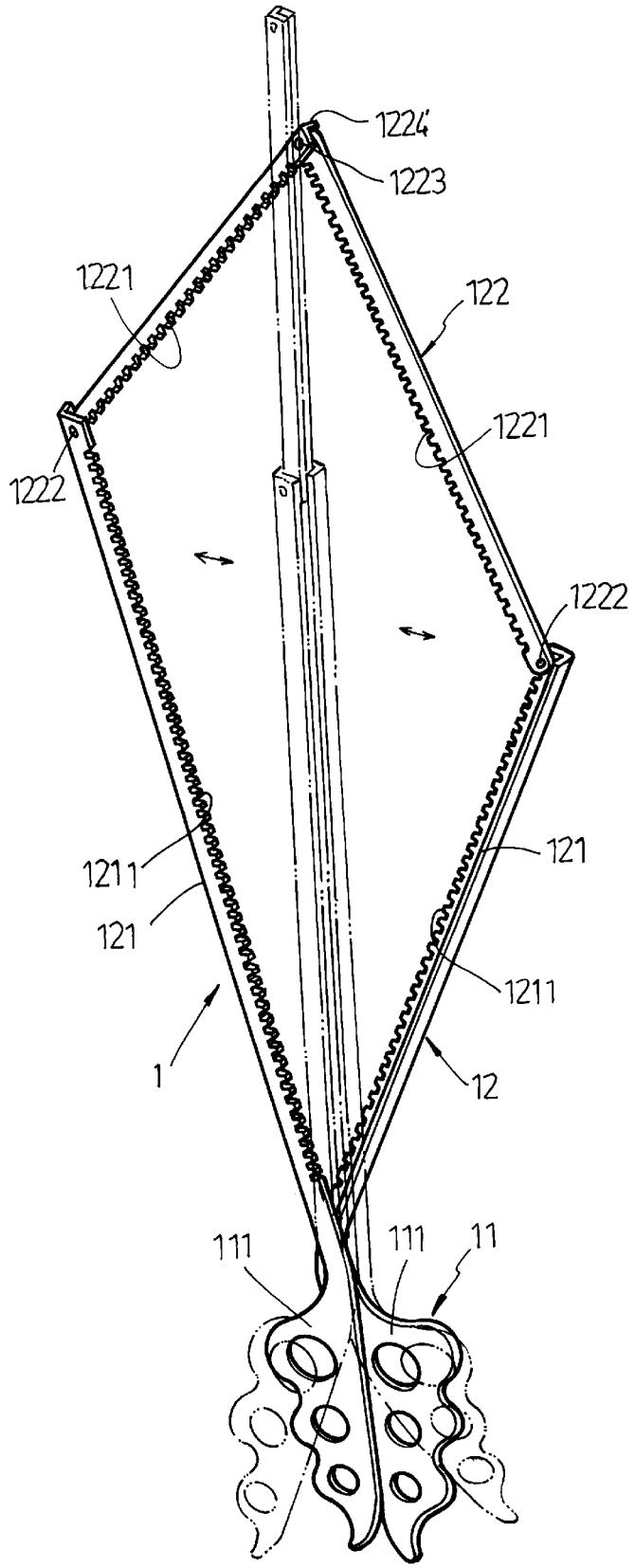
FIG. 9 is a schematic drawing showing a bubble blowing toy according to a second embodiment of the present invention operated.

Referring to FIG. 9 again, the stop flange 1224' is disposed reversed to the stop flange 1224 shown in FIGS. 1 through 3. When the long arms 121 are closed, the two halves of the folding arm 122 are turned outwards and closely attached together and retained in longitudinal alignment with the closed long arms 121.

Referring to FIGS. from 1 through 8 again, the operating unit 11 is comprised of two hand grips 111 respectively extended from the long arms 121 and pivoted together by the common pivot 112. Further, a torsional spring 113 is mounted around the pivot 112, having two opposite ends respectively connected to the hand grips 111. The torsional spring 113 imparts an outward pressure to the hand grips 111, causing the long arms 121 to be retained in the closed position. When the hand grips 111 are squeezed inwards by hand, the long arms 121 are opened, and the folding arm 122 is extended out. Because the bubble blowing unit 12 is normally retained in the closed position it can conveniently be inserted into the solution container 2 to take up the solution. When the bubble blowing unit 12 is pulled out of the solution container 2 and opened, a triangular membrane of the solution is suspended from the long arms 121 and the folding arm 122 for blowing into a big bubble.

It is to be understood that the drawings are designed for purposes of illustration only, and are not intended as a definition of the limits and scope of the invention disclosed.

What the invention claimed is:

1. A bubble blowing toy comprising:

a) a solution container holding a solution, the container having an opening; and, b) a bubble blowing device having:

i) a control unit with first and second elongated arms connected thereto at proximal ends so as to be movable between a closed position wherein the first and second elongated arms are insertable into the solution container through the opening, and an open position wherein distal ends of the first and second elongated arms are displayed away from each other such that the first and second elongated arms have a substantially V-shaped configuration;

ii) a folding arm pivotally connected to the distal ends of the first and second elongated arms, the folding arm having two portions pivotally connected together, lengths of each of the two portions being less than lengths of the first and second elongated arms; and, iii) a stop flange extending from one of the two portions of the folding arm so as to engage the other of the two portions when the elongated arms are in the open position thereby limiting an extended angle of the folding arms.

2. The bubble blowing toy of claim 1 wherein each elongated arm has an inner side and further comprising serrations formed on the inner side of each elongated arm.

3. The bubble blowing toy of claim 2 wherein the folding arm has an inner side and further comprising serrations formed on the inner side of the folding arm.

4. The bubble blowing toy of claim 1 wherein at least one of the first and second elongated arms is pivotally connected to the control unit.

5. The bubble blowing toy of claim 4 wherein the control unit comprises a handle.

6. The bubble blowing toy of claim 5 further comprising a push bar movably located on the handle and connected to the elongated arm pivotally connected to the control unit whereby movement of the push bar relative to the handle moves the elongated arm between the closed and open positions.

7. The bubble blowing toy of claim 6 wherein both elongated arms are pivotally connected to the control unit and wherein the push bar is connected to both of the elongated arms.

* * * * *